US008282056B2

(12) United States Patent
Parker et al.

(10) Patent No.: US 8,282,056 B2
(45) Date of Patent: Oct. 9, 2012

(54) END STOP BRACKET FOR A MOBILE SHELVING TRACK

(75) Inventors: Brian Maurice Parker, Panorama (AU); George Giles Campbell, Brighton (AU)

(73) Assignee: Glidestore Freetrack Pty Ltd, Norwood (AU)

( * ) Notice: Subject to any disclaimer, the term of this patent is extended or adjusted under 35 U.S.C. 154(b) by 352 days.

(21) Appl. No.: 12/673,872

(22) PCT Filed: Aug. 18, 2008

(86) PCT No.: PCT/AU2008/001205

§ 371 (c)(1), (2), (4) Date: Feb. 17, 2010

(87) PCT Pub. No.: WO2009/023910

PCT Pub. Date: Feb. 26, 2009

(65) Prior Publication Data

US 2011/0031196 A1 Feb. 10, 2011

(30) Foreign Application Priority Data

Aug. 17, 2007 (AU) ..... 2007904426

(51) Int. Cl.
*F16M 11/00* (2006.01)

(52) U.S. Cl. ..... 248/200; 104/249; 248/345.1

(58) Field of Classification Search ..... 248/200, 248/345.1, 205.1, 548; 211/162; 104/249, 104/254, 259

See application file for complete search history.

(56) References Cited

U.S. PATENT DOCUMENTS

| | | | | |
|---|---|---|---|---|
| 5,524,979 | A * | 6/1996 | Carson et al. | 312/319.2 |
| 7,264,863 | B2 * | 9/2007 | Haymond | 428/99 |
| 7,770,861 | B2 * | 8/2010 | Huxtable et al. | 248/345.1 |
| 8,099,813 | B2 * | 1/2012 | Parker et al. | 14/69.5 |
| 2004/0065224 | A1 | 4/2004 | Gilbert et al. | |
| 2005/0162053 | A1 | 7/2005 | Larsen, Jr. | |
| 2007/0221596 | A1 | 9/2007 | Rioux | |

FOREIGN PATENT DOCUMENTS

| | | |
|---|---|---|
| DE | 202004012847 U | 10/2004 |
| GB | 909976 | 11/1962 |
| WO | 9842232 A2 | 10/1998 |

OTHER PUBLICATIONS

EPO, Extended European Search Report, Aug. 4, 2011, pp. 1-7, Rijswijk, Netherlands.

* cited by examiner

*Primary Examiner* — Ramon Ramirez
(74) *Attorney, Agent, or Firm* — Christopher C. Dremann, P.C.

(57) ABSTRACT

The present invention relates to an end stop bracket for a longitudinal mobile shelving track adapted to moveably support a mobile shelving unit thereabove, the end stop bracket including a main body shaped to cap an end of said longitudinal track, a means of attachment to the end of the longitudinal track, and a means of reducing impact loads resulting from contact between the mobile shelving unit and the end stop bracket.

9 Claims, 10 Drawing Sheets

END STOP BRACKET FOR A MOBILE SHELVING TRACK

CROSS REFERENCE TO RELATED APPLICATION

This application claims the benefit of priority of International Patent Application PCT/AU2008/001205, filed on Aug. 18, 2008, the entire disclosure of which is incorporated herein by reference.

FIELD OF THE INVENTION

The present invention relates to an end stop bracket adapted to be mounted to the end of a mobile shelving track for capping the end of the track and absorbing shelving unit impact.

BACKGROUND OF THE INVENTION

Mobile shelving systems typically include a plurality of mobile shelving units which are moveable along spaced apart tracks, with each individual shelf unit being a tall and narrow structure having an array of horizontal shelves.

Typically, a track will include an end stop bracket so that a runner which supports the shelving unit thereabove, which slideably engages the track, and which is not able to move beyond the track ends. There is a problem with existing end stop brackets known to the present inventor, in that, often the force of impact from the runner when moved toward the end of the track dislodges or damages the bracket. This can lead to further damage over prolonged use and further impact, including the rollers (which are typically suspended from the runner) becoming offset from the center of the tracks upon which they traverse, and the ends of the track lifting from the ground.

It is therefore an object of the present invention to overcome at least some of the aforementioned problems or to provide the public with a useful alternative.

SUMMARY OF THE INVENTION

Therefore in one form of the invention there is proposed an end stop bracket for a longitudinal mobile shelving track adapted to moveably support a mobile shelving unit there above, the end stop bracket including a main body shaped to cap an end of said longitudinal track, a means of attachment to the end of the longitudinal track and a means of reducing impact loads resulting from contact between the mobile shelving unit and the end stop bracket, the means of reducing impact loads being in the form of a plurality of transversely extending ribs forming an elastomeric buffer to absorb the impact load when the mobile shelving unit is urged towards the end stop bracket.

Preferably said longitudinal track includes a hollow profile, and the means of attachment is in the form of elongate joining pins adapted to be received in the hollow profile and locked thereto using fastening means.

In preference the fastening means is in the form of at least one locking bolt adapted to engage coaxially aligned apertures extending through the joining pin and a lowermost surface associated with the hollow profile, from the underside of said track.

In preference the longitudinal track includes a hollow profile, and the plurality of transversley extending ribs form of a stop portion extending outwardly from the main body which corresponds substantially with the shape of at least part of the track hollow profile.

In preference the stop portion is shaped correspondingly with a central channel of the track and is adapted to be snug fit inside the central channel.

In preference the stop portion includes an upper robust portion, the plurality of ribs being suspended therefrom.

In preference the track is extruded and is substantially triangular in cross section.

Preferably the main body is also substantially triangular in shape.

In preference the longitudinal track and the end stop bracket are constructed of steel.

BRIEF DESCRIPTION OF THE DRAWINGS

The accompanying drawings, which are incorporated in and constitute a part of this specification, illustrate several implementations of the invention and, together with the description, serve to explain the advantages and principles of the invention.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 9:
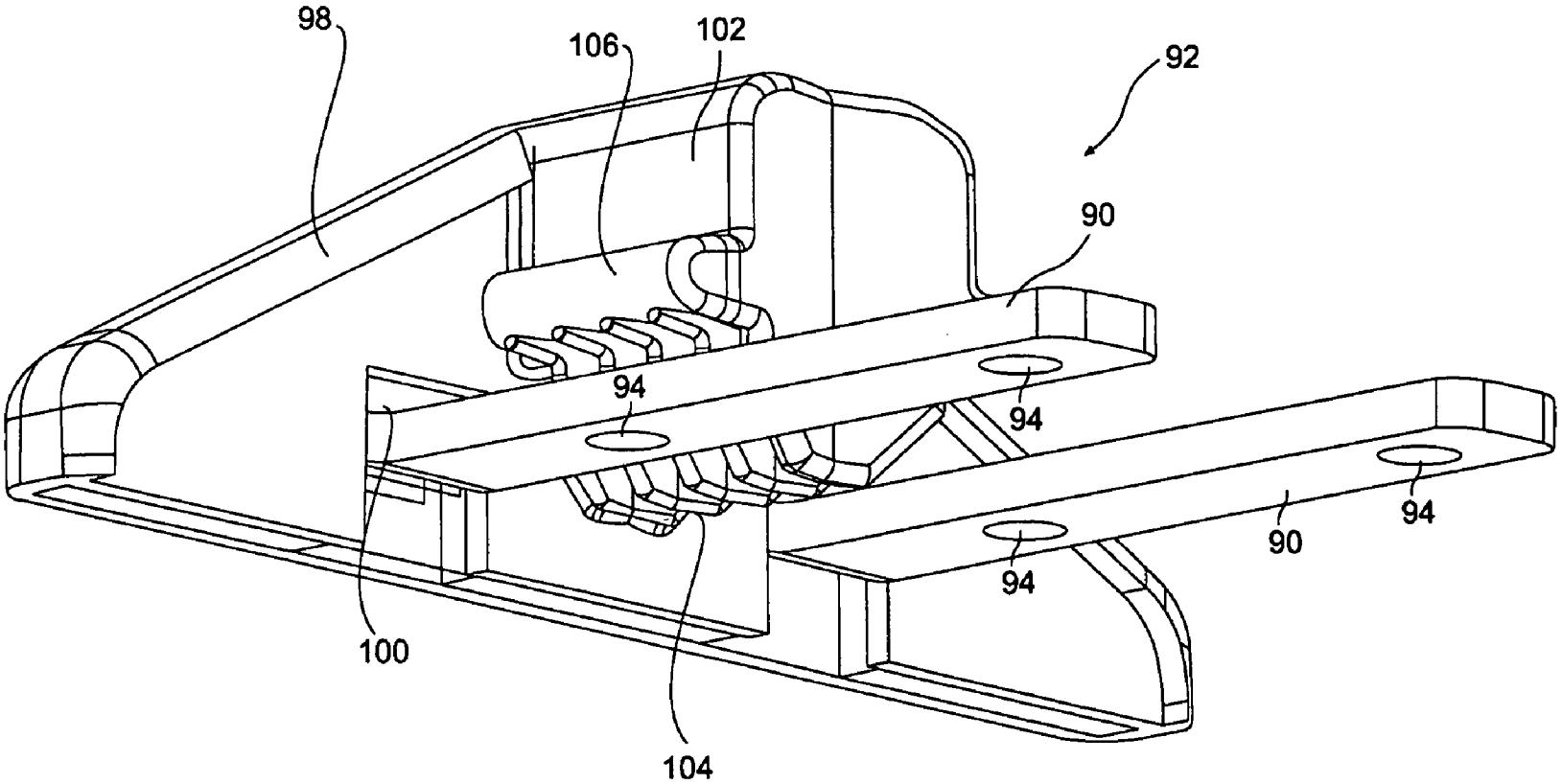
FIG. 9 illustrates a perspective view of a track end stop bracket in accordance with the present invention, forming part of the mobile shelving track and runner assembly of FIG. 1.

While the present invention is directed specifically towards an end stop bracket for a mobile shelving track assembly, as shown in FIG. 9, other components which form part of a complete mobile shelving system according to a preferred embodiment of the invention are also described.

A track and runner assembly 10 for mobile shelving is shown in FIGS. 1-4. The assembly 10 comprises one or more longitudinal tracks 12, a longitudinal runner 14 configured to slideably engage each track 12 and to support a shelving unit (not shown), otherwise known as a compactus, there above, and transverse cross members 16 for connecting two or more runners 14 together. A typical shelving unit is adapted to be mounted above two runners 14 slideable along two tracks 12 which are spaced apart by a distance corresponding approximately with the length of the shelving unit.

Figure 5:
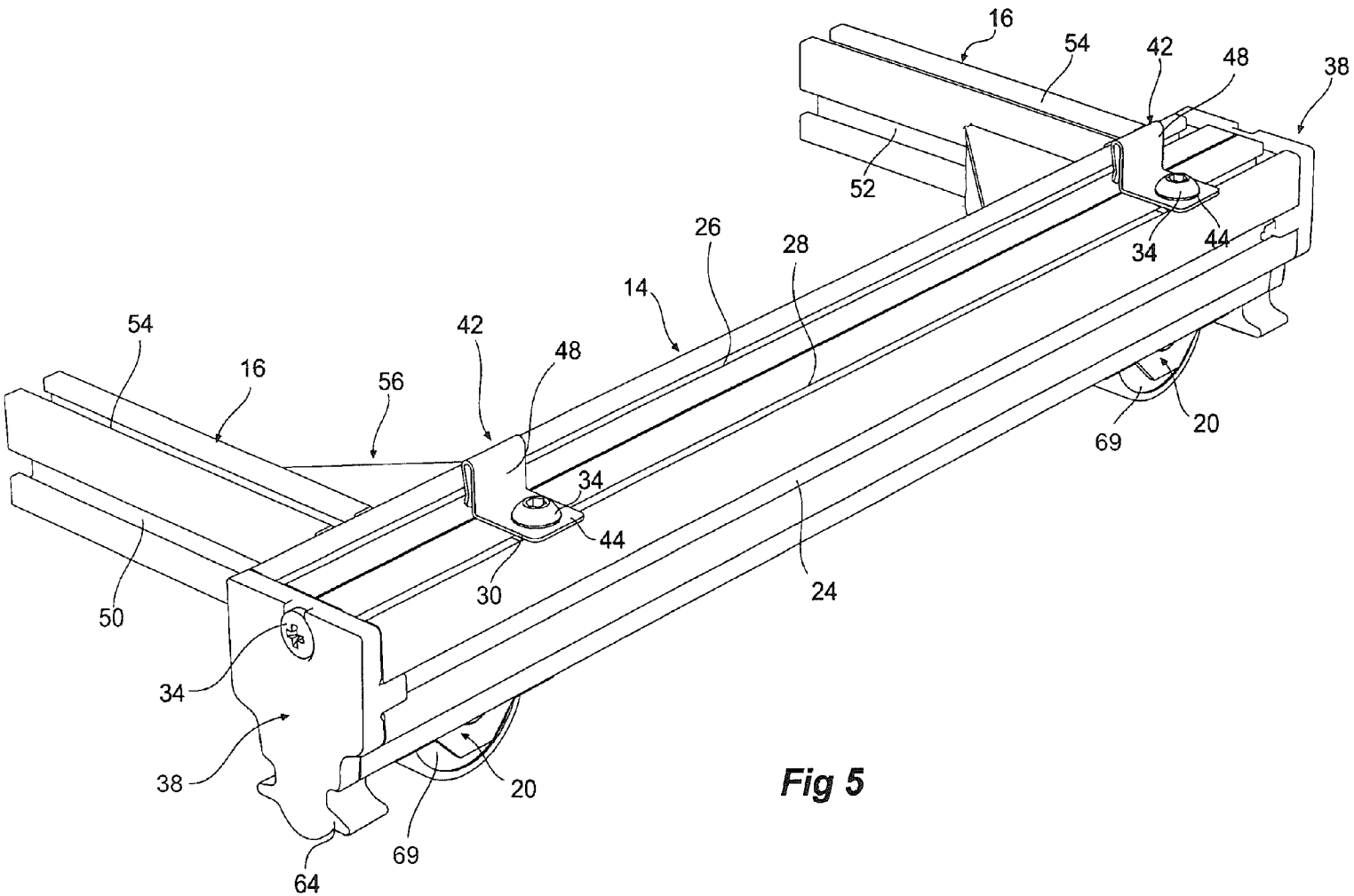
FIG. 5 illustrates a top perspective view of the runner and cross members forming part of the mobile shelving track and runner assembly of FIG. 1.
Figure 6:
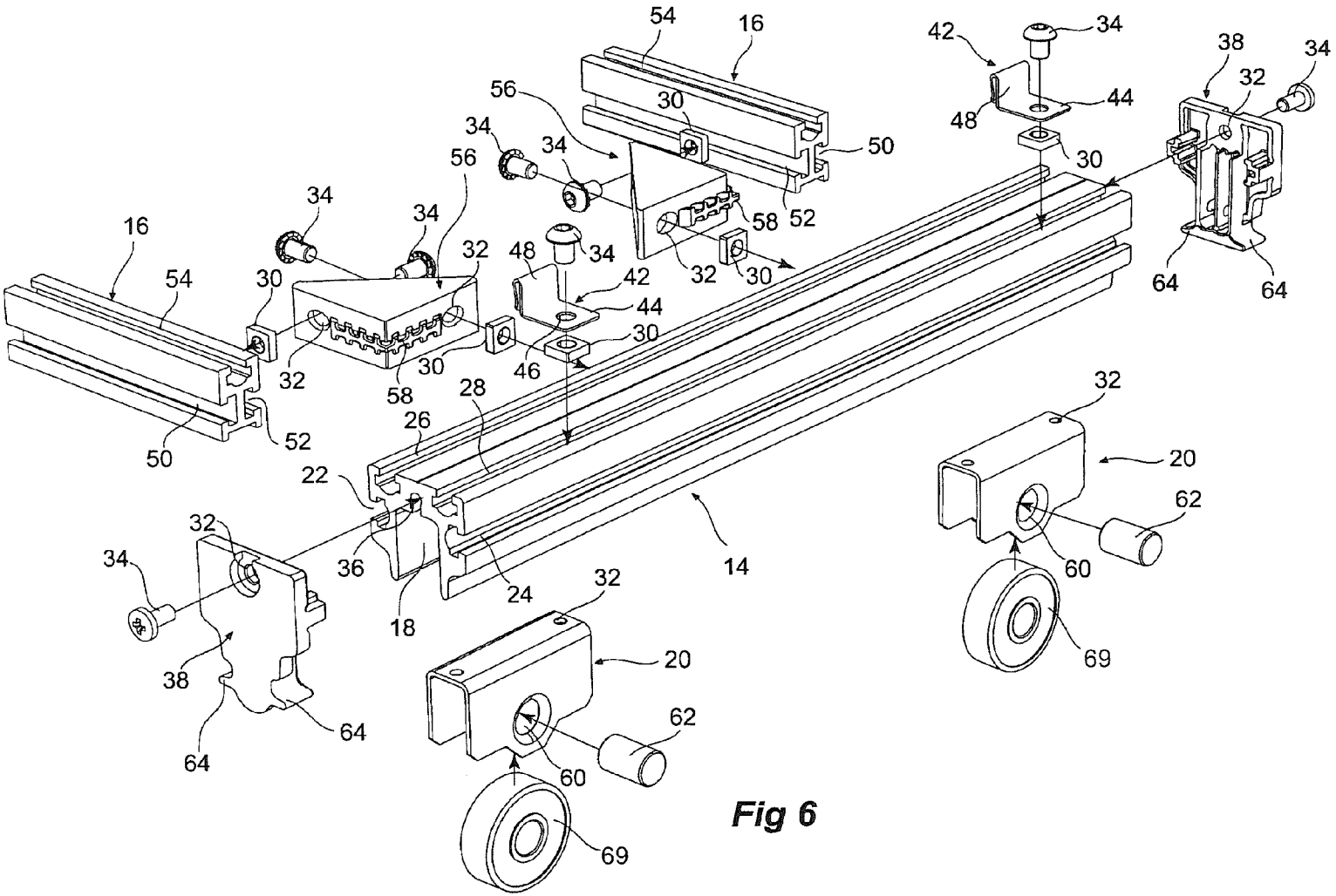
FIG. 6 illustrates an exploded perspective view of the runner and cross members shown in FIG. 5.

The runner 14 of the present invention is shown most clearly in FIGS. 5-6. The runner 14 is substantially in the form of an inverted U-shaped extrusion, having a primary channel 18 extending there along adapted to accommodate one or more roller cartridges 20, and four slots 22, 24, 26 and 28 extending along right, left and top sides thereof. In particular, slot 22 extends along the left side of the runner 14, slot 24 extends along the right side, and slots 26 and 28 extend along the upper side of the runner 14. The slots 22, 24, 26 and 28 are preferably in the form of T-slots, shaped like so to accommodate square nuts 30 having internal threads. This provides for fast, versatile construction because the nut 30 provides an anchor point for external items at any point along the runner 14.

Once the nut 30 is moved to a desired position, the item, which typically includes a mounting aperture 32, is moved into position so that the aperture 32 and nut 30 become coaxially aligned. A screw 34 is used to extend through the aperture 32, through the slot 22, 24, 26 or 28, and into the nut 30 for threaded engagement therewith. Extending centrally along the top of the primary channel 18 is a further slot 36 providing a further mounting means for the roller cartridges 20 and end brackets 38, as will become apparent.

The runner 14 has been designed so that no additional post-processing of the extrusion is required after it has been cut, i.e. no drilling, slotting, etc.

The following description relates to examples of items which are mountable to the runner 14. Some of these are necessary items, for example, the transverse cross members 16, but others are not necessarily essential, such as a locking bracket 40 for example. It is to be understood that other items which are not shown and described herein, could also be mounted to the runner 14, for example, sensors (not shown), motors (not shown), mechanical drive devices, and the like.

Mounted above the runner 14 are one or more clips 42 configured for engagement with a corresponding receiving means located beneath the shelving unit, such as a correspondingly shaped aperture (not shown), for example. Clip 42 includes a mounting portion 44 having a mounting aperture 46 extending therethrough, and a second portion 48 upstanding from the mounting portion 44 and doubled over for engagement with the corresponding receiving means. The clips 42 are fixed to the runner 14 using a screw 34 adapted to extend through aperture 46 to thereby engage a nut 30 located within slot 28, as described above. In the embodiment shown, there are two spaced apart clips 42 for each runner 14.

Two cross members 16 are adapted to extend between runners 14 on spaced apart tracks 12 to provide the required support for each shelving unit. The cross members 16 are in the form of substantially I-shaped extrusions having slots 50, 52 and 54 on left side, right side and top sides thereof, respectively. In preference the slots 50, 52 and 54 are also substantially in the form of T-slots engageable by bolt/nut connections as described above, when mounting external items thereto.

Each cross member 16 is coupled to the runner 14 using hollow, triangular shaped brackets 56 at the junction therebetween. The perpendicular walls of the bracket 56 include outwardly extending projections 58 being shaped to fit snugly within the side slots 52 and 22 of both the cross member 16 and the runner 14 respectively. The projections 58 are ribbed to facilitate insertion through the slots and so that any impact loads on the bracket 56 are reduced.

Also located on the perpendicular walls of the bracket 56 are mounting apertures 32. The mounting apertures 32 on the bracket 56 are positioned to fix the cross member 16 in a perpendicular arrangement relative to the runner 14, that is, each perpendicular wall of the bracket 56 is mounted to the cross member 16 and runner 14 respectively. Again, nuts 30 and screws 34 are preferably used for connecting the respective components.

In order for the runner 14 and hence the shelving unit to be slideable along the track 12, the runner 14 must also include means of housing the roller cartridges 20 mentioned above. The present invention provides that the primary channel 18 of the runner 14 accommodates one or more roller cartridges 20.

Each roller cartridge 20 is also of an inverted U-shaped configuration and of a size to fit inside the runner primary channel 18. The top side of the cartridge 20 includes two spaced apart mounting apertures 32, so that when the cartridge 20 is positioned in a desired location along the channel 18, it can be secured using self-tapping screws 34 extending through the apertures 32 and into slot 36. Such a configuration means that the roller cartridge 20 may be fitted to the runner 14 without the need for drilling. Typically, each shelving unit will include a roller cartridge 20 at the longitudinal ends of each runner 14, however, there may be circumstances where more are required, and the runner primary channel 18 may accommodate for this.

The roller cartridge 20 includes larger, co-axially aligned apertures 60 extending through its side walls. A pin 62 which extends through the apertures 60 is used to maintain a roller 69 inside the cartridge 20. The roller 69 is rotatable about the pin 62 and allows the runner 14 and hence the shelving unit to move relative to the track 12, as will become apparent.

Also mountable to the runner 14 are end brackets 38 as mentioned. Not only are the end brackets 38 used to cap off the ends of the runner 14, they are configured to prevent the shelving unit from tilting. Each end bracket 38 is in the form of a rigid housing having an internal structure which corresponds substantially in shape with the cross section of the runner extrusion, so that it may engage an end thereof. A self-tapping screw 34 is used to fix the end bracket 38 in place, the screw 34 extending through an uppermost aperture 32 of the end bracket 38, and into the runner slot 36. At the base of the end bracket 38 are two transversely extending shoulders 64 which when engaged with the track 12 (as described below), are designed to prevent the shelving unit from toppling over. The end bracket 38 therefore constitutes the anti-tilt means of the assembly 10.

Figure 7:
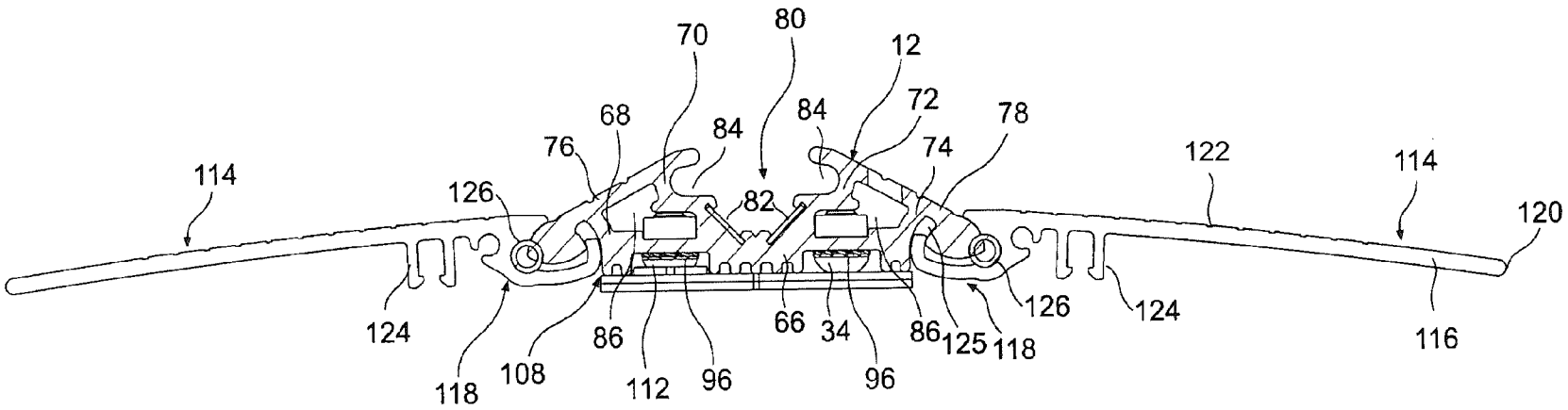
FIG. 7 illustrates a cross-sectional view of the track forming part of the mobile shelving track and runner assembly of FIG. 1.
Figure 8:
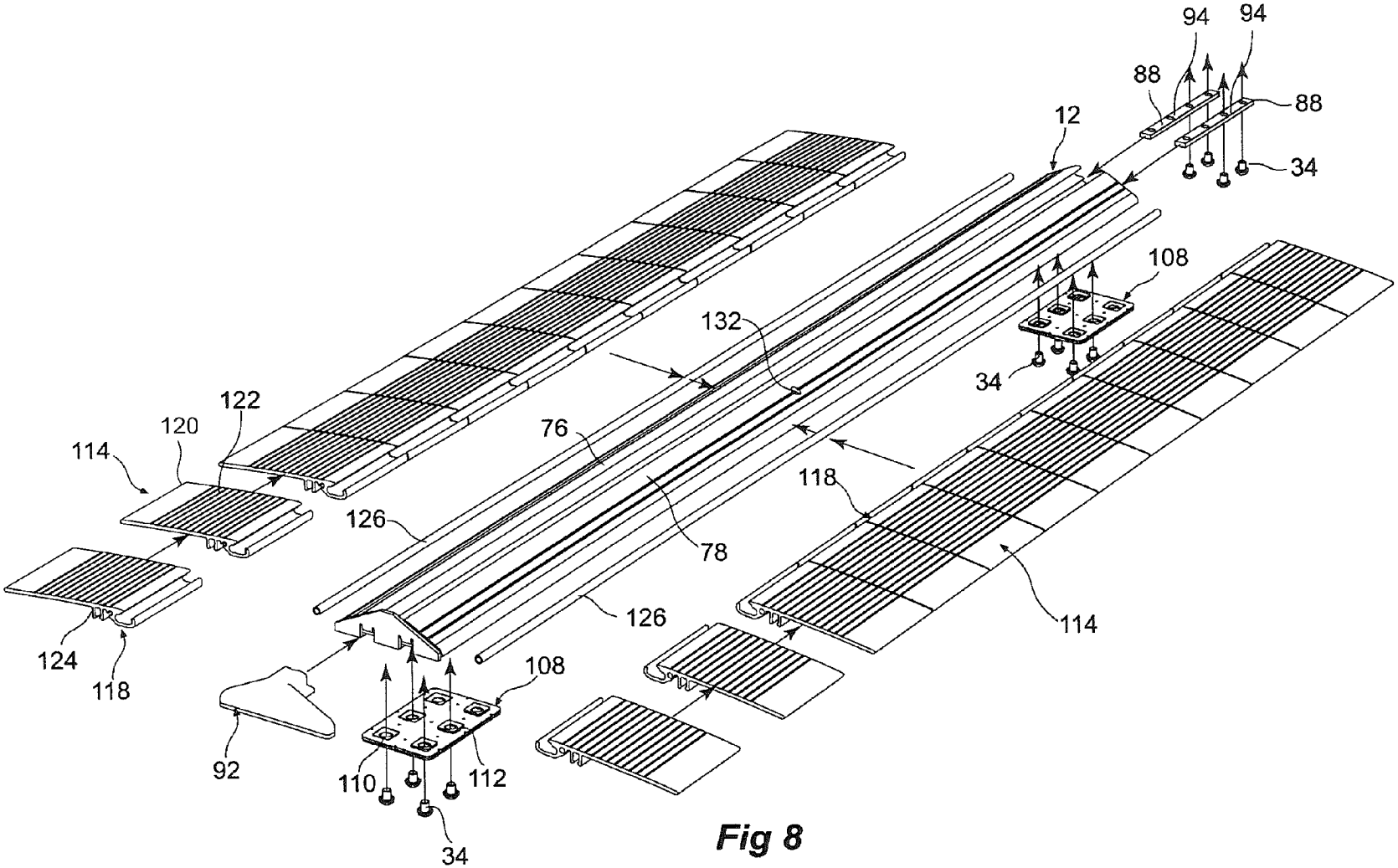
FIG. 8 illustrates an exploded perspective view of the track shown in FIG. 7.

Referring now to FIGS. 7-8 in particular, it can be seen that the track 12 is also made up of an extruded length of metal and includes a hollow profile. The track 12 comprises generally a base 66, internal walls 68, 70, 72 and 74, and external walls 76 and 78 which are each integrally formed. The external walls 76 and 78 at upper ends of the track 12 extend a short distance inwardly, past internal walls 70 and 72. The base 66 and the external walls 76 and 78 form a substantially triangular cross-sectional shape; however, because the external walls fall short of meeting at an apex, they define a central channel 80 extending along the track 12.

The internal geometry of the track 12, in particular the high, hollow profile, allows for robust but unobtrusive track joining, and should remove the need for installers to use glue and fit fasteners with high precision, as will become apparent.

The inside surface of internal walls 70 and 72 are shaped to perform two functions. Firstly, at a lowermost region of the channel 80, the internal walls 70 and 72 define a V-shaped guide 82, which is the surface upon which the rollers 69 are supported. The rollers 69 engage the guide 82 centrally with both edges of the roller 69 contacting the guide. The weight of the shelving unit on the roller 69 retains it in the desired position, and allows sufficient friction for it to rotate smoothly across the guide 82. In order to prevent wear, and to strengthen the guide 82, retaining beads (not shown) retain crinoline strips, generally made of steel, along the V-shaped guide 82.

Secondly, disposed above the V-shaped guide 82 are opposed recesses 84 for accommodating shoulders 64 associated with the end bracket 38. Those skilled in the art will readily appreciate that when the assembled runner 14 is positioned above the track 12, with the shelving unit supported there above, any lateral movement of the shelving unit would be restricted by the shoulders 64, because they are prevented from upward movement by the upper ends of the external walls 76 and 78. Accordingly, tilting of the shelving units is prevented. This is particularly important when the shelving units have significant weight on the top shelves making them prone to such movement.

Figure 1:
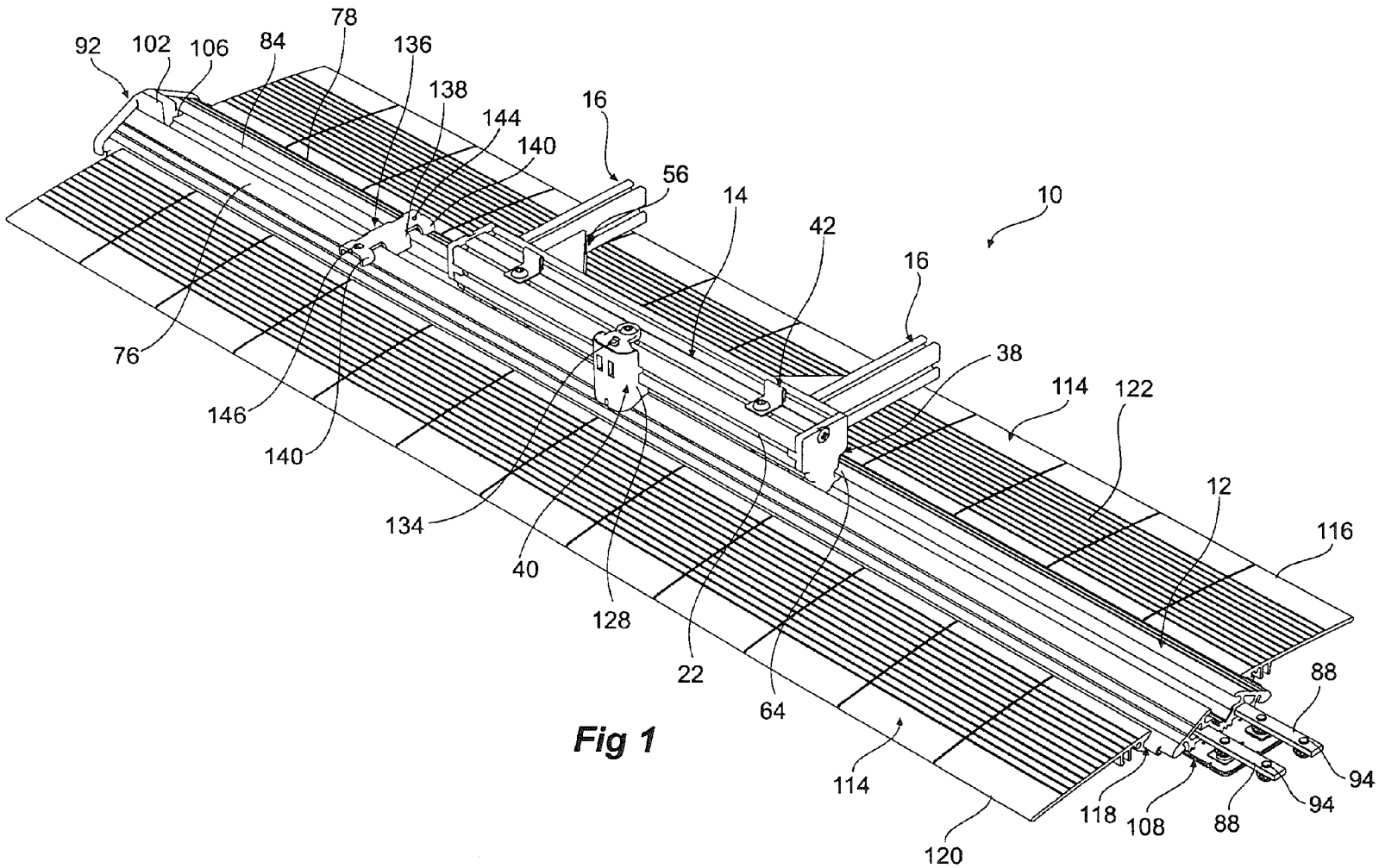
FIG. 1 illustrates a top perspective view of a mobile shelving track and runner assembly.
Figure 2:
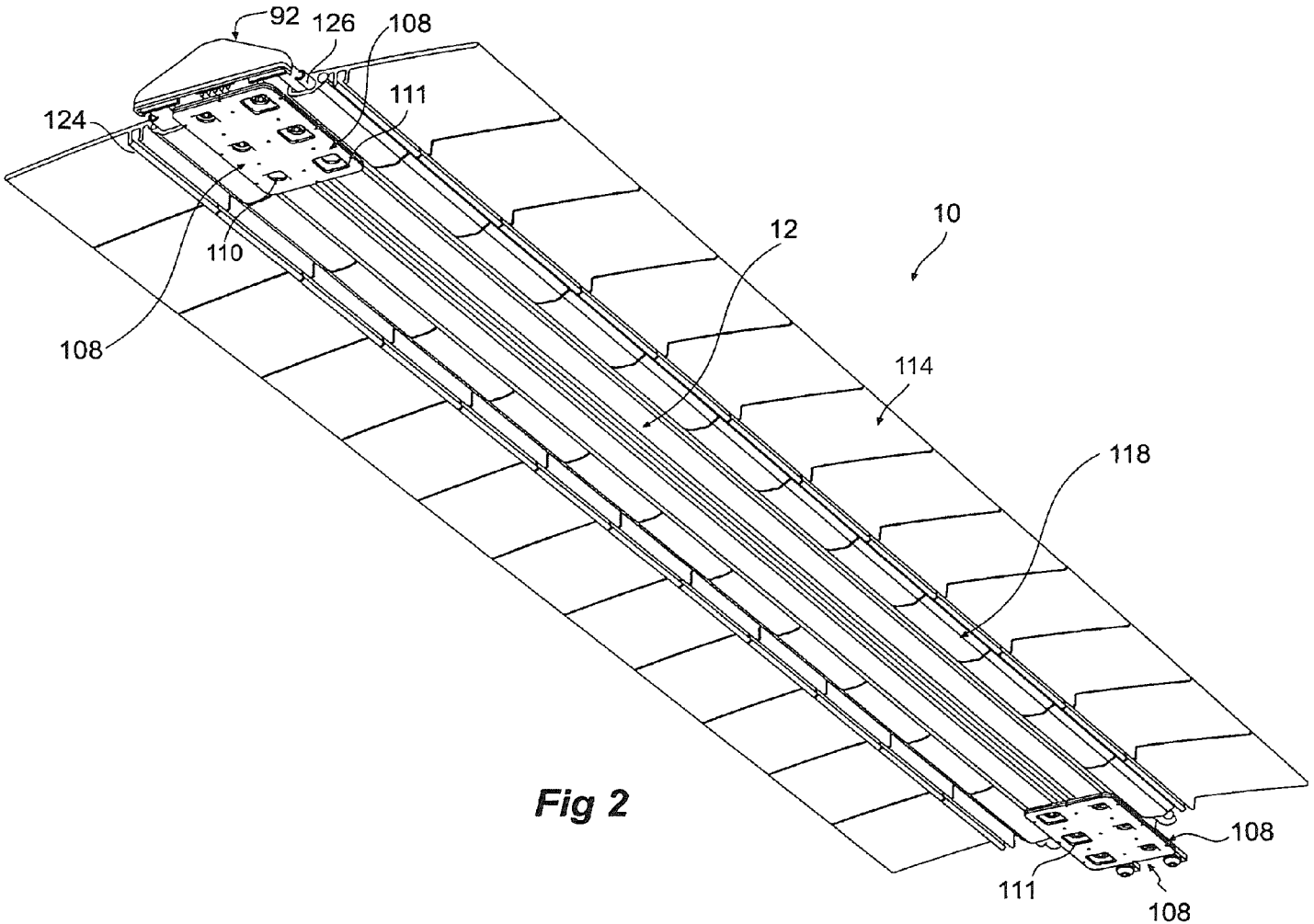
FIG. 2 illustrates an underside perspective view of the mobile shelving track and runner assembly of FIG. 1.
Figure 3:
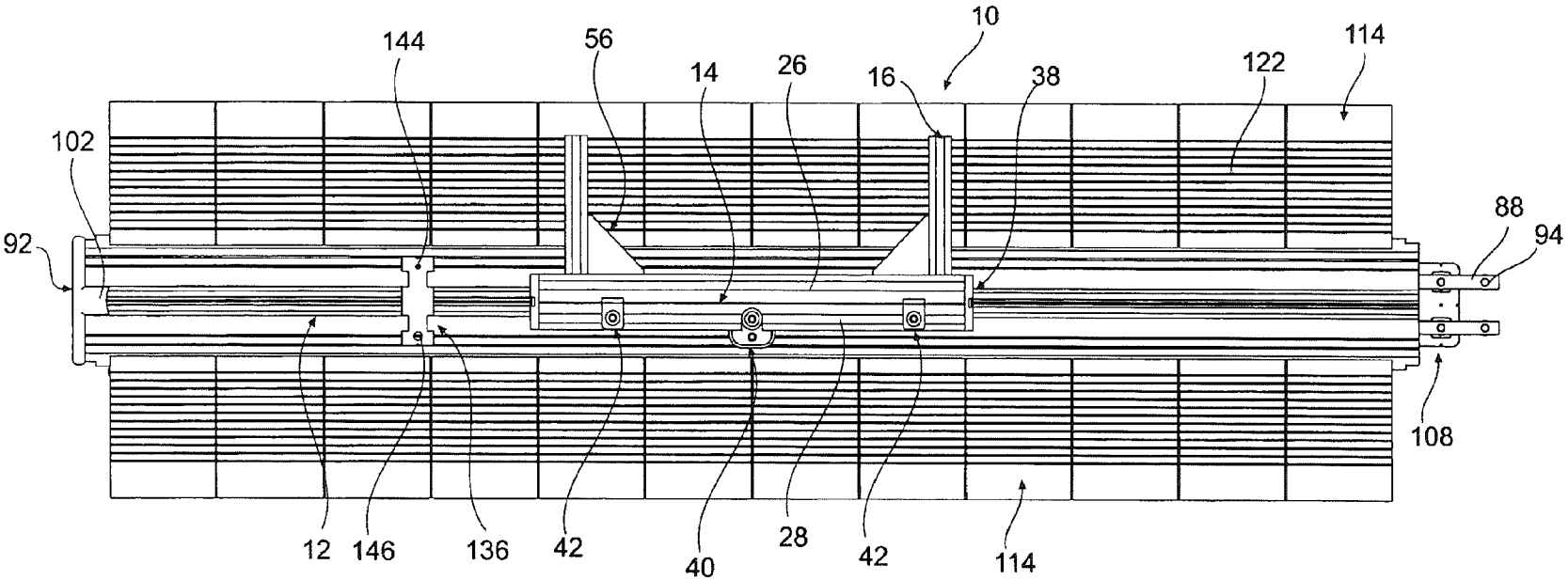
FIG. 3 illustrates a top view of the mobile shelving track and runner assembly of FIG. 1.
Figure 4:
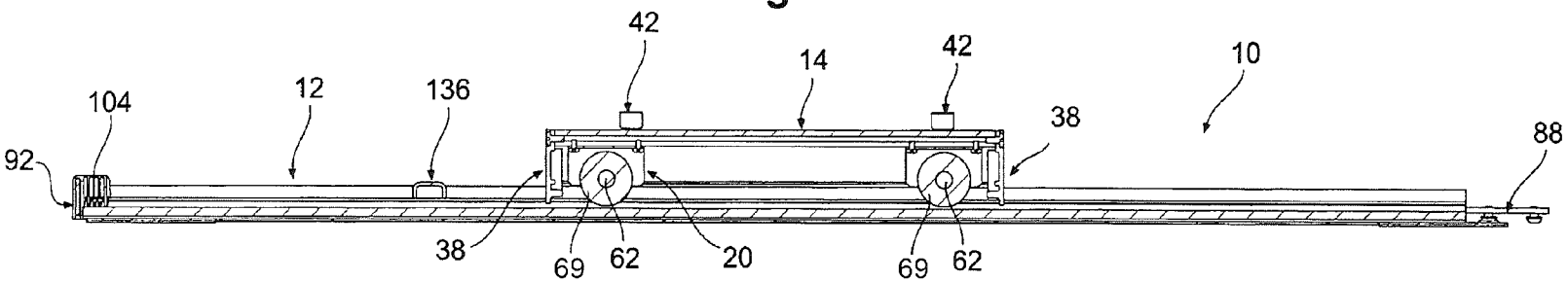
FIG. 4 illustrates a side view of the mobile shelving track and runner assembly of FIG. 1.

Between internal walls 68 and 70, and internal walls 72 and 74, hollow regions 86 are defined. The hollow regions 86 are adapted to accommodate joining pins 88 which are used to join two track ends together. The hollow regions 86 also accommodates pins 90 (FIG. 9) associated with an end stop bracket 92 of the track 12. Therefore, the end stop bracket 92 is mounted to the end of the track 12 using two joining pins 90 associated therewith, while for joining two segments of track 12 together, individual joining pins 88 are used, as shown in FIG. 1.

In both cases, the joining pins 88 and 90 include a plurality of apertures 94 spaced apart there along, and are adapted to be inserted into the hollow regions 86 of the track 12 until they are in co-axial alignment with apertures 96 (FIG. 7) extending through the base 66 of the track 12. Self-tapping screws 34 are once again used to engage the coaxial apertures 94, 96 and thereby secure the components together.

The end stop bracket 92, as its name suggests, is adapted to be mounted to the end of a track 12. For example, there could be three or four track segments joined to form a single track, wherein the two endmost track segments include end stop brackets 92 for preventing the runner 14 from travelling beyond the tracks. An enlarged view of the end stop bracket 92 is shown in FIG. 9 and it can be seen that it comprises a substantially triangular shaped housing 98, joining pins 90 extending outwardly from an internal bracket plate 100, and a stop portion 102 extending between the joining pins 90 and into channel 80 when the end stop bracket 92 is mounted to the track 12.

The stop portion 102 includes a plurality of ribs 104 which provide an elastomeric buffer for reducing impact loads. Shelving units when moved generate a significant amount of force due to their weight and therefore require that the track end stops be robust enough to dampen such force upon impact. The end stop bracket 92 also includes anti-tilt shoulders 106 as per the runner end brackets 38.

The height of the track 12 also needs to be maintained level along its length. It is also preferable for the height of the track 12 to also be easily adjustable even after assembly. One or more packers 108 shown most clearly in FIG. 2 and the cross sectional views, are used to achieve this. Each packer 108 is substantially rectangular in shape and includes a 3×2 matrix of apertures 110 extending therethrough. One row of three apertures 110 on the packer 108 includes elevated square surrounding portions 112. The adjacent row of three apertures 110 include locating means 111 for engaging the elevated square surrounding portions 112 of a second packer 108 positioned there beneath. Each adjacently stacked packer 108 is rotated by 180 degrees relative to the other.

One or more packers 108 (depending on the desired height) are adapted to sit beneath the joining pins 90 at the ends of the track 12, as well as beneath the joining pins 88 at one or more joints between track segments. The apertures 110 are designed to accommodate the head portions of the self-tapping screws 34 which engage the joining pins 88 and 90. Those skilled in the art will readily appreciate that any number of stacked packers 108 could be added or removed to increase or decrease height of a particular section of track 12.

A further advantage to the improved stiffness characteristics of the track extrusion is that it allows for wider spacing of the packers 108 along the track 12.

The assembly 10 includes a plurality of optionally attachable ramp sections 114. These are used to provide a smooth surface over the track 12 and prevent the track 12 from forming a tripping hazard. Each ramp section 114 includes a substantially rectangular body 116 having a hook section 118 at one end thereof, and a straight edge 120 at the opposed end adapted to lie substantially flush with the ground when assembled. The ramp section body 116 includes a plurality of ribs 122 on its upper surface for gripping purposes. There are reinforcing members 124 positioned below the body 116 which are advantageous because they reduce the overall weight of the ramp section and maintain strength. The hook section 118 extends downwardly from the body 116, then inwardly and upwardly with respect to the track 12.

Figure 10:
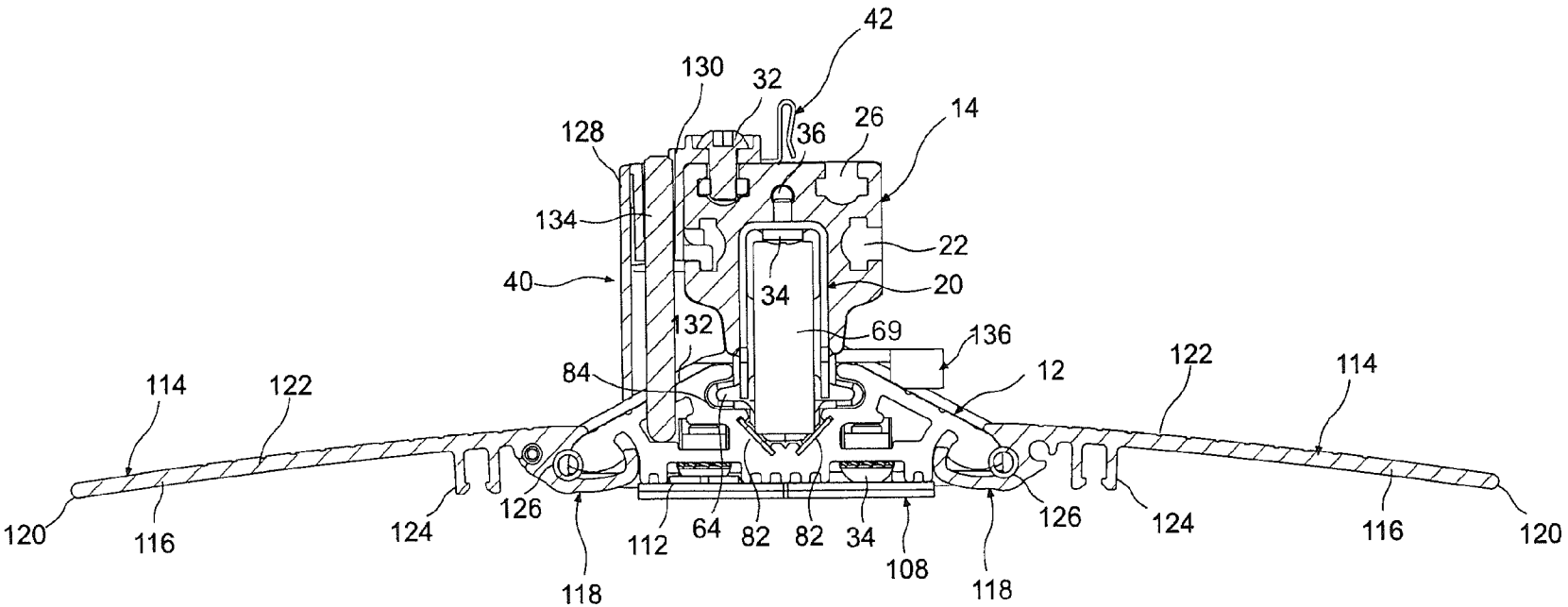
FIG. 10 illustrates a cross sectional view of the mobile shelving track and runner assembly of FIG. 1, without the cross members attached.
Figure 11:
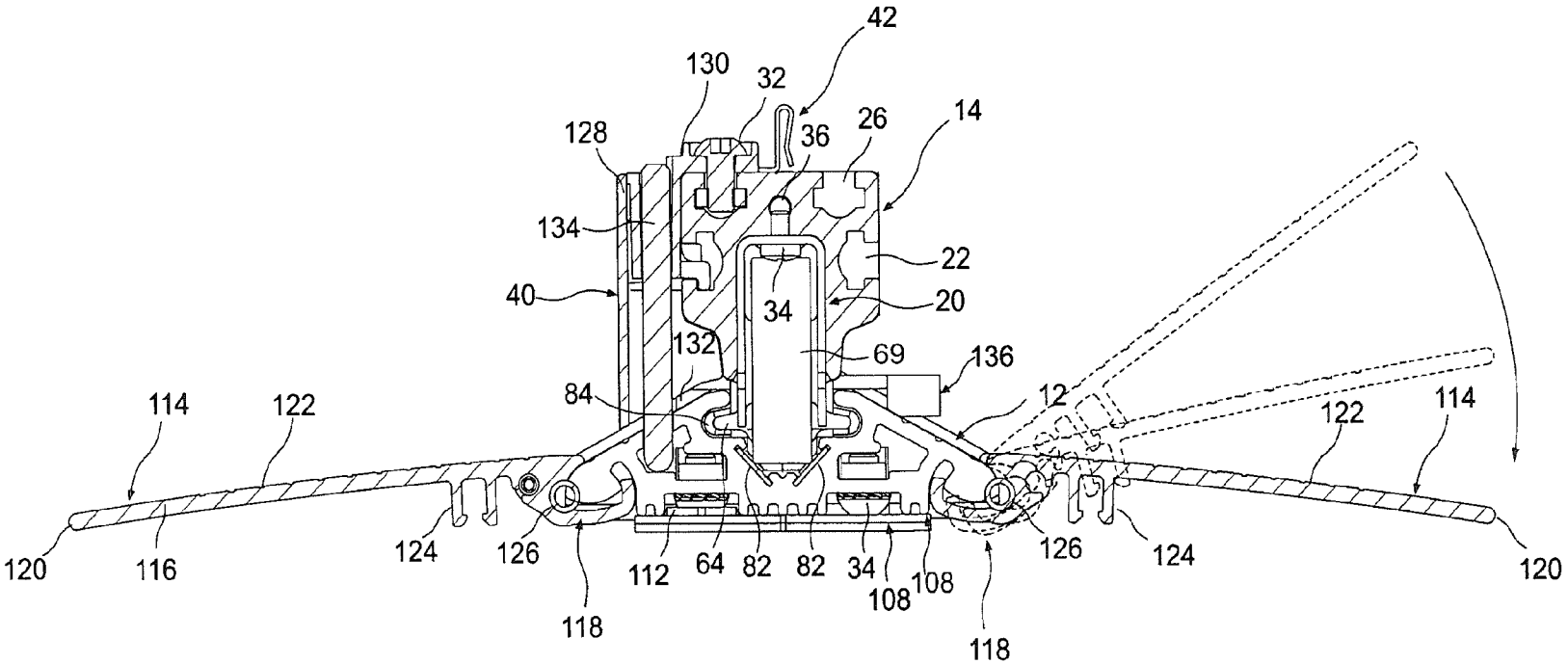
FIG. 11 illustrates the cross sectional view of FIG. 10 showing the way in which the ramp section is mounted to the track.

The track extrusion is also designed to accommodate the ramp sections 114. Turning now to FIGS. 10-11, between the lower end of the external walls 76 and 78, and the internal walls 68 and 74 respectively, there are defined receiving channels 125 for engaging the hook section 118 of each ramp section 114. In particular, each ramp section 114 is configured to engage the receiving channels 125 by way of a rotatable snap-fit. FIG. 12 illustrates this process, whereby the hook section 118 is inserted into the receiving channel 125 and then urged upwardly while rotating edge 120 of the body downwardly until the hook section 118 is snap-fit in place. This ramp pivot geometry is designed to allow removal and refitting of ramps (for re-levelling purposes) without having to lift up or up-end the track 12.

A rubber tube 126 is also inserted between the rounded end of the external walls 76 and 78 and the junction between the downwardly and inwardly extending surfaces of the hook section 118. The tube 126 provides a down-force and minimises ramp "kick-up" which could create a tripping hazard A further advantage to the rubber tube 126 is that it also acts as a flexible joiner, assisting in handling and simultaneous fitting of multiple ramp sections to the track 12.

The ramps 114 are optional as the track extrusion has been designed to be aesthetic and safe even if used without ramps 114.

Finally, the runner 14 is able to be locked at different positions along the track 12. A locking bracket 40 is shown in the drawings which is also engageable to an upper slot 28 of the runner 14, as well as the side slots, by means described above. The locking bracket 40 includes a housing 128 mounted to the runner 14, the housing 128 defining a vertical chamber extending downwardly alongside the runner 14 to the track 12. The chamber includes a vertical aperture 130.

When the shelving unit is to be locked, the runner 14 is moved along the track 12 until the vertical aperture 130 becomes co-axially aligned with an aperture 132 that has been pre-drilled into the track 12. Once aligned, a locking pin 134 can be inserted through the co-axially aligned apertures 130 and 132, into the hollow region 86 where it rests on the base 66, thereby locking the runner 14 to the track 12.

A jig 136 is provided for forming the pre-drilled apertures 132 in the track 12. The jig 136 is an elongate structure mountable to the track 12 in a transverse arrangement as shown in FIG. 1. The jig 136 includes a downwardly extending section 138 at its centre which extends inside channel 80, as well as downwardly extending sections 140 at ends thereof which abut with the external walls 76 and 78 of the track 12. On opposed ends of the jig 136 are apertures 144 and 146.

The jig 136 is first adapted to be mounted to the track 12 so that aperture 144 is positioned over a desired point to be drilled. The purpose of this smaller aperture 144 is to mark the track 12 with a suitable tool (not shown), the mark acting as a locating guide for a drill bit or the like used to drill a hole through the track 12. The jig 136 is then demounted from the track 12, rotated by 180 degrees, and mounted to the track 12 again so that the larger aperture 146 extends over the marked point. A drill (not shown) can then be used to drill a hole through the track 12 where marked.

It is to be understood that the design of some of the components shown and described could change where necessary. For example, where there is a mechanical driving means associated with the runner 14, one of the track external walls 78 would extend a greater distance outwards from the channel 80 and include a flat upper surface (not shown) for accommodating a drive wheel (not shown). Such a track would therefore include a further hollow region 86. In such circumstances, the same packers 108 could be used but simply rotated by 90 degrees so that instead of extending longitudinally relative to the track 12, it would extend transversely.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow, except where the context requires otherwise due to express language or necessary implication, the word "comprising" is used in the sense of "including", i.e. the features specified may be associated with further features in various embodiments of the invention.

The invention claimed is:

1. An end stop bracket for a longitudinal mobile shelving track adapted to moveably support a mobile shelving unit thereabove, the end stop bracket comprising:

a main body shaped to cap an end of the longitudinal mobile shelving track;

a means of attachment to the end of the longitudinal mobile shelving track, said means of attachment being in the form of at least one elongate joining pin adapted to be received in a hollow profile of the longitudinal mobile shelving track and locked thereto using fastening means; and a means of reducing impact loads resulting from contact between the mobile shelving unit and the end stop bracket, said means of reducing impact loads being in the form of a plurality of transversely extending ribs forming an elastomeric buffer to absorb the impact load when the mobile shelving unit is urged towards the end stop bracket.

2. An end stop bracket as in claim 1 wherein said fastening means is in the form of at least one locking bolt adapted to engage coaxially aligned apertures extending through the joining pin and a lowermost surface associated with the hollow profile of the longitudinal mobile shelving track.

3. An end stop bracket as in claim 1 wherein the longitudinal mobile shelving track is extruded and is substantially triangular in cross section.

4. An end stop bracket as claim 3 wherein said main body is also substantially triangular in shape.

5. An end stop bracket for a longitudinal mobile shelving track including a hollow profile and adapted to moveably support a mobile shelving unit thereabove, the end stop bracket comprising:

a main body shaped to cap an end of the longitudinal mobile shelving track;

a means of attachment to the end of the longitudinal mobile shelving track; and a means of reducing impact loads resulting from contact between the mobile shelving unit and the end stop bracket, said means of reducing impact loads being in the form of a plurality of transversely extending ribs forming an elastomeric buffer to absorb the impact load when the mobile shelving unit is urged towards the end stop bracket, said plurality of transversely extending ribs further forming part of a stop portion extending outwardly from said main body which corresponds substantially with the shape of at least part of the hollow profile of the longitudinal mobile shelving track.

6. An end stop bracket as in claim 5 wherein said stop portion is shaped correspondingly with a central channel of the longitudinal mobile shelving track and is adapted to be snug fit inside the central channel.

7. An end stop bracket as in claim 5 wherein said stop portion includes an upper robust portion, said plurality of transversely extending ribs being suspended therefrom.

8. An end stop bracket as in claim 5 wherein the longitudinal mobile shelving track is extruded and is substantially triangular in cross section.

9. An end stop bracket as in claim 8 wherein said main body is also substantially triangular in shape.

* * * * *